US006691471B2

(12) United States Patent
Price

(10) Patent No.: US 6,691,471 B2
(45) Date of Patent: Feb. 17, 2004

(54) MORTARLESS WALL STRUCTURE

(75) Inventor: Raymond R. Price, Rochester, MN (US)

(73) Assignee: Alliance Concrete Concepts Inc., Rochester, MN (US)

( * ) Notice: Subject to any disclaimer, the term of this patent is extended or adjusted under 35 U.S.C. 154(b) by 80 days.

(21) Appl. No.: 10/015,052

(22) Filed: Dec. 11, 2001

(65) Prior Publication Data

US 2002/0056237 A1 May 16, 2002

Related U.S. Application Data

(63) Continuation-in-part of application No. 09/547,206, filed on Apr. 12, 2000.

(51) Int. Cl.[7] ..... E04B 2/56; B60R 27/00

(52) U.S. Cl. ..... 52/169.12; 52/238.1; 52/293.3; 52/712; 52/DIG. 3

(58) Field of Search ..... 52/DIG. 3, 238.1, 52/243.1, 169.12, 293.3, 477, 605, 564, 586.1, 712

(56) References Cited

U.S. PATENT DOCUMENTS 1,509,424 A * 9/1924 Garrard
1,970,414 A * 8/1934 Brown
2,787,812 A * 4/1957 Long
3,722,156 A * 3/1973 Bryant
3,753,323 A * 8/1973 Nesbitt
4,043,088 A * 8/1977 Payton
4,214,412 A * 7/1980 Barylski ..... 52/169.12
4,352,261 A * 10/1982 Wargo
5,363,620 A * 11/1994 Liu ..... 52/586.1 X
5,501,050 A * 3/1996 Ruel
5,906,080 A * 5/1999 diGirolamo et al.
6,125,587 A * 10/2000 Woods ..... 52/169.12
6,374,552 B1 * 4/2002 Price ..... 52/169.12

* cited by examiner

*Primary Examiner*—Robert Canfield
(74) *Attorney, Agent, or Firm*—Moore, Hansen & Sumner

(57) ABSTRACT

A wall structure comprising a plurality of columns of preformed, lightweight, stacked blocks, with the columns of blocks connected to each other by a plurality of elongated, vertically oriented, support beams. Preferably, the wall structure is operatively connected to a structure by one or more brackets. Each bracket includes a wall engaging portion and a structure engaging portion, and is configured and arranged to allow constrained movement of the wall structure in a predetermined direction. Preferably, the bracket is positioned such that the wall engaging portion is collaterally aligned with the longitudinal axis of a support beam so that one surface of the wall engaging portion is in a confronting relation therewith and an opposing surface of the wall engaging portion is in a confronting relation with a block.

17 Claims, 4 Drawing Sheets

MORTARLESS WALL STRUCTURE

This is a Continuation-in-part of application Ser. No. 09/547,206, filed Apr. 12, 2000.

BACKGROUND OF THE INVENTION

The present invention is relates to a wall structure. More specifically, the present invention relates to a wall structure that may be used in a variety of interior and exterior applications, for example, as a skirting wall, as wainscoting, as a retaining wall, as a swimming pool wall, as a veneer or fascia, as cladding or siding, as a fence, and as a load-bearing or non load-bearing wall.

Transportable structures such as mobile homes, trailer homes, modular homes and recreational vehicles, by their very nature, are usually not intended to be built upon a conventional foundation. Rather, they are brought or driven to a location where they may remain for indeterminate periods of time. Often, over an extended period at a particular site, such structures may start to settle differentially onto or in the ground due to factors such as deflating tires or local variations in soil bearing capacities. Additionally, factors such as erosion and freeze-thaw cycles may also cause such structures to shift and/or tilt. In order to prevent such unwanted movement in such structures and ensure that a structure is level regardless of the ground's topography, the structures are often placed on stilts that extend from the structure or upon piles that extend from the ground or even on isolated footings that distribute the weight of a structure over a relatively large surface area. While this solves the aforementioned problem of shifting and/or sinking, it often results in an unsightly visible gap in the area between the ground and the bottom of the structure.

Various attempts to cover the unsightly visible gap have included the use of plants, natural material such as rocks and wood and man-made products such as cement, masonry and plastics. These attempts have proven to be either prohibitively expensive, difficult to install and/or disassemble, or unattractive and unable to withstand sustained exposure to nature's elements. Attempts that tend to be prohibitively expensive or difficult to install include, for example, wall structures constructed of large, custom-made, cement slabs having decorative faces, and standard masonry blocks held together with mortar. Attempts that fall into the latter category include such relatively fragile and easily breakable products as wooden or plastic lattices, and synthetic panels designed to simulate stones or bricks.

Consequently, there is a need for an easy to assemble and/or disassemble, lightweight and sturdy, inexpensive wall structure for covering the gap between the ground and an elevated structure such as a mobile home.

In other applications, where brick, stone, or concrete is used as veneer or fascia, for fencing, and as load-bearing and non load-bearing walls, etc., these structures are constructed with an eye towards permanence. That is, the structures are not meant to be easily dismantled. This means that the component parts are often able to interconnect with each other and/or with a support framework in some fashion. This usually entails the use of robust connections such as mechanical fasteners, adhesives, cement, or the like. For example, many types of veneers are typically coated with adhesive or cementatious material to enable them to be securely and directly bonded to a structure. Or, as another example, walls may be constructed in a conventional manner with blocks and mortar. Alternatively, wall structures may comprise heavy, interlocking blocks that rely on size and weight to achieve some measure of permanence. As one may well imagine, each of the aforementioned structures would be difficult and time consuming to reconfigure, remove or repair should the need arise. And while the construction of some of these structures typically requires specialized knowledge, skills and tools to achieve, it will be appreciated that disassembly may require other, additional specialized knowledge, skills and tools to achieve. In light of these shortcomings, there is an additional need for a wall structure that may be easily assembled, disassembled and rebuilt or reconfigured by an unskilled user without damage to the constituent parts of the wall structure and which may be used as a veneer, fascia, cladding, fence, or as a load-bearing or non load-bearing wall.

SUMMARY OF THE INVENTION

One embodiment of the present invention provides a masonry block wall system for use in skirting elevated structures. The blocks are shaped to be stacked in vertically independent, self-supporting columns, strengthened and linked together by specially shaped, lightweight, lateral support beams positioned between adjacent columns, and stabilized by inverted u-shaped brackets which are attached at or near the bottom of an elevated structure. In an alternative embodiment, a u-shaped bracket is provided with an arm that is rotatably attached thereto and which is movable into a position that facilitates attachment to a generally vertical surface.

Each block comprises a front face, a rear face, top and bottom surfaces, and side surfaces, and each side surface includes an outwardly opening, vertically oriented groove for receiving a portion of a support beam. The top and bottom surfaces are configured to facilitate a stacking relationship between adjacent courses of blocks such that they are generally coplanar. This relationship is most easily achieved by making the top and bottom surfaces substantially collateral, planar and relatively perpendicular to rear and/or front faces.

One purpose of the beams is to keep the vertically independent, self-supporting columns of blocks from buckling when subjected to a force normal to the plane of the column. This strengthening is accomplished providing the beams with lateral extensions that are configured to be received in aligned grooves at the sides of vertically stacked blocks. Another purpose of the beams is to link adjacent columns together in a colonnade-like arrangement to form a wall structure. This is also achieved with the aforementioned lateral extensions and grooves. As may be expected, the beams provide very little, if any support in a vertical direction. The columns are considered independent because, unlike conventionally constructed masonry or stone walls, the joints between adjacent blocks are in alignment with each other rather than being offset as in a running bond. This enables the columns of blocks to move up and down relative to each other, without appreciably altering the inherent continuity of a wall structure. As will be appreciated, the rigidity of the blocks provides enough support to prevents a column from failing in the vertical direction. The support beams are preferably comprised of weather resistant metal or synthetic material, such as poly-vinyl chloride (PVC), nylon or the like.

The use of the lateral support beams also obviates the need for mortar between the blocks. This mortarless wall structure system is advantageous over traditional brick and mortar walls for obvious reasons. First, fewer materials are required to build a wall. Second, the materials are easier to handle and manipulate, and no special tools or skills are required. Third, a wall can be constructed under conditions that would not be possible using traditional brick and mortar construction and a person need not be concerned about time constraints imposed by drying mortar. Fourth, the intimate block-to-block contact between adjacent blocks results in very tight joints that allow the wall to appear monolithic or seamless. It is also possible to create walls that have the appearance of conventional block and mortar construction. Fifth, the loose block system can be constructed on a variety of surfaces, including sand, gravel, dirt, or building elements such as H-beams, flooring, base blocks, etc. It is not necessary to pour a foundation.

The lateral support beams also allow the blocks to be substantially thinner than conventional masonry blocks. These thin, lightweight blocks are not only easier to handle and ship, but require less material and time to fabricate. The blocks are generally about 1 to 4 inches (2.5–10 cm.) thick, about 6 to 12 inches (15–30 cm.) in height and about 6 to 24 inches (15–60 cm.) in width, and preferably have a thickness on the order of around 2½ inches (6.0 cm.). As one may appreciate, the combination of the thin blocks and the support beams facilitates construction of masonry wall structures in locations and configurations that were heretofore not possible using thin blocks alone. The resulting wall structure of this system is surprisingly strong and it may even be used to provide support to an elevated structure. Once a wall structure is installed about an elevated structure, the elevated structure may be lowered onto the blocks of the wall. Alternatively, the blocks may serve as a skirt, which improves the aesthetics of the structure and keeps animals, litter, snow, etc. from intruding or being otherwise introduced beneath the structure. In this embodiment, it is not necessary that the blocks make actual contact with the structure.

The loose block system also allows the wall to be easily disassembled and reassembled. This not only gives flexibility during initial construction, but also allows later renovations to be made quickly and inexpensively. For instance, it may be desirable or required to vent elevated structures having skirting walls, to prevent the buildup of moisture or condensation between the ground and the elevated structure. Such vents can be easily installed into an existing wall, especially if they are of similar dimensions and configurations as the blocks. The blocks of a given column are simply removed and reinstalled, replacing one of the blocks with the vent. Other auxiliary items, such as an access door or lights, could be installed in a similar manner.

The wall design of the present invention also allows a wall corner to be constructed without supporting beams or mortar. Two walls are simply aligned to form a butt joint and fasteners such as appropriate plastic pegs or screws and plastic inserts are used to fasten one wall to the other. Alternatively, construction mastic, or a similar type of adhesive, may be applied instead of or in combination with the screws. Again, ease of installation is greatly improved by the loose block, mortarless system of the present invention.

Another embodiment of the wall structure uses a differently configured bracket than the aforementioned u-shaped bracket. It too, is used to operatively connect the wall structure to a support. The bracket of this embodiment, however, attaches in a slightly different manner than the u-shaped bracket. Instead of straddling the upper portion of a top-most block as with the u-shaped bracket of the aforementioned embodiment, this bracket has one end that is configured to be positioned within space defined by opposing vertical grooves of adjacent blocks. That is, the bracket is designed to be installed at or near the sides of a column. The other end of the bracket is configured to be attached at or near the bottom of a structure. An advantage with this bracket it that it is able to provide support for the wall structure in two directions, while allowing movement of wall components relative thereto in a third direction. As will be appreciated, this bracket may be easily installed and removed without the need for special training or tools. Preferably, the bracket of this embodiment is L-shaped, although it is envisioned that other shapes are possible. For example, the bracket may be linear, or it may be linear and have an axial twist in it. Or, the structure engaging portion may be provided with a u-shape or even its own integral fastener.

These and other objectives and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

DETAILED DESCRIPTION

Figure 1:
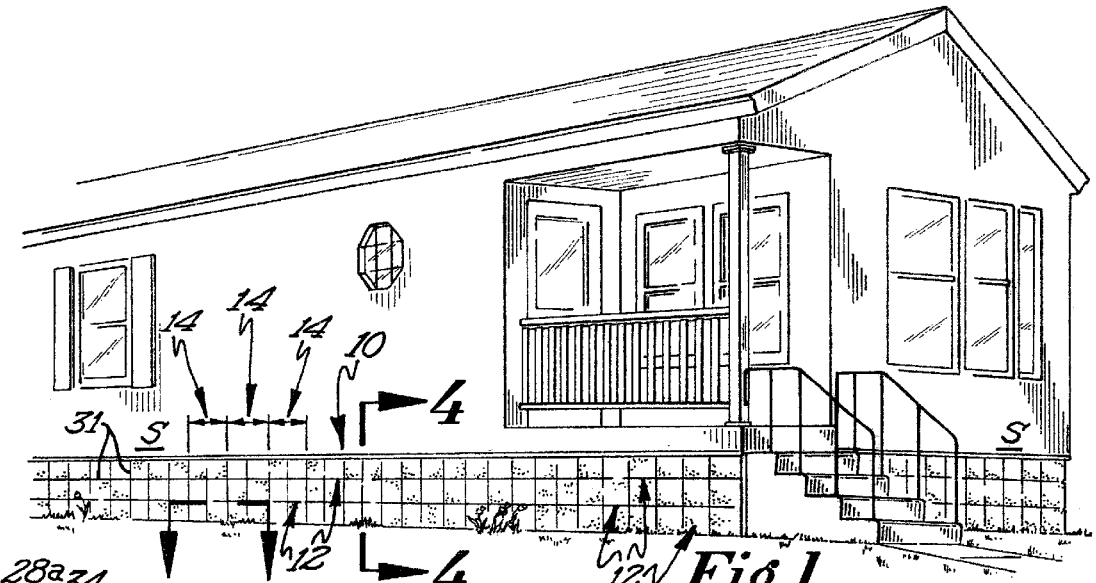
FIG. 1 is a perspective view of an elevated structure skirted with an embodiment of the wall structure of the present invention.

Referring generally now to the drawings and first to FIGS. 1–5, a preferred embodiment of a wall structure 10 of the present invention as it may be used in conjunction with an elevated structure is shown (See, FIG. 1). The wall structure 10 is comprised of a plurality of blocks 12 arranged in columns 14, with the blocks in each column 14 held in place by vertically oriented, lateral support beams 16, and with each beam 16 operatively connecting adjacent columns 14 together in a colonnade-like fashion. Downwardly opening u-shaped brackets 18 attached at or near the bottom of a structure (shown in dashed lines in FIG. 4) being skirted, are configured and arranged to receive an upper portion of the top block 12 of pre-selected columns 14 to help stabilize and prevent the wall structure 10 from tipping rearwardly or forwardly. As used herein, the term "forward" means away from the center of the elevated structure (and along the "z" direction in a three-dimensional coordinate system relative to a block) and the term "rearward" means toward the center of the elevated structure (also along the "z" direction in a three-dimensional coordinate system relative to a block).

Figure 2:
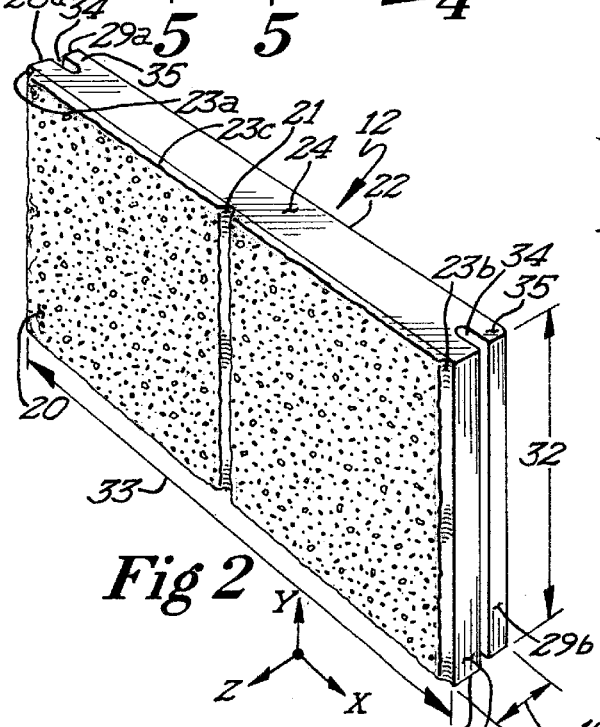
FIG. 2 is a perspective view of an embodiment of a block of the present invention.

Attention is now directed to the individual components of wall structure 10. FIG. 2 depicts a preferred embodiment of block 12. It can be seen that block 12 is generally panel-shaped and includes a front face 20, a rear face 22, a top surface 24, a bottom surface 26 and pairs of side surfaces 28A, 29A and 28B, 29B, respectively. Block 12 is preferably made of a dry composite masonry material in a molding operation. It is envisioned, however, that other materials could be used, such as concrete, fiberglass, ceramics, hard plastics, dense foam, or even wood. Though the general shape of the blocks is more important to achieve the present invention than the material used, it has been found that the aforementioned preferred dry composite masonry material provides the most desirable combination of strength, appearance, economy, and ease of manufacturing.

Front face 20 is spaced from rear face 22 by a predetermined distance herein defining the depth 30 of block 12. As shown in FIG. 2, it is envisioned that front face 20 is formed with a roughened or rustic surface. Such surfaces are commonly formed during block fabrication, where a mold is cast and the casting is later split or fractured into two blocks along a predetermined plane, with the plane of separation between the two blocks defining a pair of opposing front faces. This is not necessary to carry out the spirit of the invention, however, and a block 12 may be formed by other known methods and a front face 20 could, alternatively, be dressed, or modified or otherwise worked in any desired manner.

A vertically oriented splitting recess 21 may be provided on the front face 20 of block 12 to enable the block 12 to be fashioned into predetermined shapes. Here, the splitting recess 21 is depicted as bisecting the block 12. However, it is understood that the splitting recess 21 may be located and oriented elsewhere on the block 12. That is, the splitting recess 21 could be off-center, or horizontal, diagonal, etc. Moreover, it is also understood that a block may be provided with more than one splitting recess, if desired.

Front face 20 also includes marginal areas 23A, 23B, 23C and 23D that will now be briefly discussed. As may be expected, the number of marginal areas corresponds to the number of edges of the front face 20. These marginal areas may be worked or modified, if desired, to produce different visual effects. Here, the desired effect is for the marginal areas to simulate splitting recesses 21. Thus, the marginal areas 23A, 23B, 23C and 23D are formed so that when blocks 12 are positioned in intimate contact with each other in a wall structure, the cross-sectional profiles of their marginal areas, when combined, simulate splitting recesses 21 (See also, FIGS. 5–9). As depicted the splitting recesses 21 have a cross-sectional profile that is somewhat circular, and the marginal areas 23A, 23B, 23C and 23D have cross-sectional areas that are fluted or arced. As can be appreciated, the splitting recesses and marginal areas may be configured with other cross-sectional profiles, if desired. For example, a v-shaped cross-sectional profile.

As mentioned above, the tight joints 31 between adjacent blocks 12 allow the wall structure 10 to appear monolithic or seamless. This feature may be used in combination with splitting recesses 21 and marginal areas 23A–D of the blocks 12 to create different visual effects. For example, it is envisioned that the wall structure simulate running bonds by having the blocks of each column alternate between a block with no splitting recess and worked marginal areas, and a block having a splitting recess and worked horizontal marginal areas (See, FIG. 11). Or, it is envisioned that the splitting recesses and marginal areas be selected to enable the wall structure to simulate an ashlar block wall (not shown).

Referring again to FIG. 2, top surface 24 is spaced from bottom surface 26 by a distance (taken along a "y" direction in a three-dimensional coordinate system relative to a block) to define the height 32 of block 12. When blocks 12 are arranged vertically to form a column 14, bottom surface 26 of any block 12 other than the bottom block of a column rests on the top surface 24 of the block therebelow. It is therefore preferred that top surface 24 and bottom surface 26 are configured to facilitate a stacking relationship between two blocks 12. This relationship is most easily achieved by making the top and bottom surfaces 24, 26 substantially collateral, planar and relatively perpendicular to rear face 22 and/or front face 20, as shown in the Figures. Alternatively, it is envisioned that top and bottom surfaces 24 and 26 may be complementarily shaped, and not perpendicular to rear face 22 and/or front face 20, but which permit upper and lower blocks 12 to be stacked in a vertical relationship (not shown). For example, the surfaces could be non-planar and/or irregular. Or, the surfaces could have compound curves or even interlocking segments (also not shown).

Side surface pairs 28A, 29A and 28B, 29B, respectively, are preferably somewhat perpendicular to rear face 22 and/or front face 20. As can be seen, side surface 28A is spaced from side surface 28B by a distance (taken along a "x" direction in a three-dimensional coordinate system relative to a block) to define the width 33 of block 12. Additionally, each pair of side surfaces 28A and 29A, 28B and 29B, include a substantially vertical groove 34 or channel therebetween that is configured to receive a portion of a lateral support beam 16 (See, FIG. 3). While a pair of side grooves 34 for each block 12 is preferred, it is envisioned that one side surface 28A and 29A or 28B and 29B be provided with a groove 34 and the other side surface have a tongue configured to mate with the groove, thereby obviating the need for beams 16. However, in order to maintain the vertically independent characteristics of columns 14, the use of beams 16 is preferred.

Figure 3:
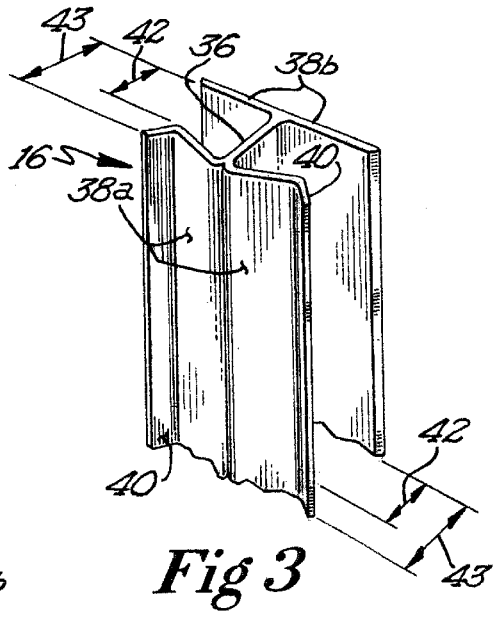
FIG. 3 is a perspective view of an embodiment of a support beam of the present invention.

Referring now to FIG. 3, the beams 16 of the present invention generally comprise an elongated spine or web 36 and at least one rib 38 that is substantially coextensive therewith. More specifically, a preferred embodiment of a beam 16, as shown includes a plurality of ribs that are arranged in a substantially coplanar and collateral relation. That is, there is a first pair of ribs 38A that are substantially coplanar and which extend away from each other. And, there is a second pair of ribs 38B that are also substantially coplanar and which extend away from each other. Note that the pairs of ribs 38A and 38B are in substantial collateral relation with each other and spaced apart from each other by a distance defined by the web 36. This configuration of two pairs of ribs 38A and 38B attached to each other by web 36 forms somewhat of an I-beam configuration. It is preferred that at least one set of ribs 38A are resiliently deformable and even more preferred that they converge slightly towards and then diverge slightly away from the other ribs 38B in a somewhat v-shaped configuration as one moves towards the ends of the ribs. This v-shaped configuration is preferred because it allows a segment 35 of a block 12 to be gripped between the ribs 38A, 38B. As will be appreciated, in order for the desired amount of gripping force to occur, the distance or span 42 between a rib 38B and the apex of the "v" of an unflexed rib 38A should be slightly less than the thickness of segment 35. And, it will also be appreciated that the distance or span 43 between the leading edge of flange 40 of the unflexed rib 38A and the rib 38B should be slightly greater than the thickness of segment 35 (See, FIGS. 5, 6 and 7). Thus, when a beam 16 is attached to a block 12 the rib 38A is deflected from its unstressed state to a stressed state and a segment 35 of a block may be gripped between ribs 38A and 38B. The ribs 38A and 38B as depicted in FIG. 3 are also preferred because they prevent unwanted movement and misalignment between blocks 12 of a given column 14 and they are able to compensate for variations in dimensions that sometimes occur during manufacture of the blocks.

Beams 16 may be attached at their upper ends to a structure being skirted if desired, preferably at or near the lowermost edge or bottom, and using conventional fastening techniques and technologies (not shown). Such attachments may be used in conjunction with or apart from brackets 18 and provide support and stability to the independent columns 14, preventing them from leaning or falling forwardly or rearwardly. Beams 16 also act to align the blocks 12 of a given column 14, by preventing lateral movement therebetween (that is, movement along the "x" direction in a three-dimensional coordinate system relative to the blocks).

Figure 4:
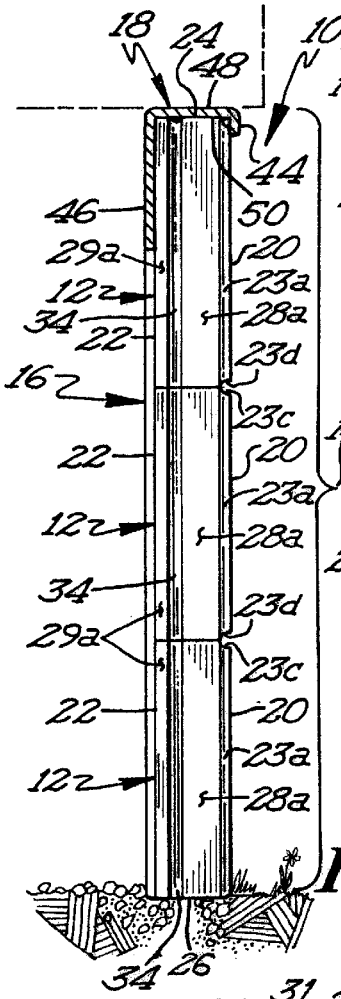
FIG. 4 is a side elevational view of a column of the present invention taken generally along lines 4—4 of FIG. 1.

Referring now to FIG. 4, the arrangement of a plurality of blocks 12 that form a column 14 can be seen. Note, that the top and bottom surfaces 24, 26 of adjacent blocks 12 are in intimate contact with each other. That is, there is no mortar or binding material therebetween. This minimizes the spacing between blocks and allows the marginal areas 23C, 23D of adjacent blocks 12 to combine and simulate horizontally oriented splitting recesses 21 (See also, FIGS. 5–9). It is envisioned that brackets 18 be used in conjunction with beams 16 to provide stability to wall 10. As can be seen, each bracket 18 comprise a front wall 44, a rear wall 46 spaced apart from front wall 44 and a top wall 48 joining the front wall 44 to the rear wall 46 in a generally inverted u-shape. Front wall 44 and rear wall 46 define an opening 50 which is configured and arranged to receive an uppermost portion of the top block 12 of a column 14. In practice, a bracket 18 is attached at or near the underside of a structure to be skirted so that the opening 50 may receive the upper portion of the top block 12 of a column 14. Preferably, the bracket 18 is positioned so that it may straddle the central region of an uppermost block 12. It may be desired to make rear wall 46 of a greater vertical dimension that front wall 44 to provide additional support. It may also be desired to provide a bracket 18 with a rear wall 46, which extends in a lateral direction further than front wall 44. Furthermore, it is envisioned that brackets 18 could be a variety of lengths. For instance, brackets 18 could be as short as one inch or as long as the entire wall. While top wall 48 of the bracket 18 is depicted in the figure as being in contact with the top surface 24 of the uppermost block 12 of a column 14, it should be understood that this need not always be the case. In situations where the wall structure 10 is not a load bearing wall, or where the terrain shifts or changes due to climate, settling, animals, roots, etc., it may be desirable to provide a gap between the top wall 48 and the top surface 24 of a block. Thus, individual columns will be able to move vertically in small increments without destroying the integrity of the wall structure 10. In that regard, it should be appreciated that beams 16 slidingly grip portions 35 of blocks 12. That is to say, the beams 16 do not grip the blocks 12 with so much force as to preclude relative movement therealong in a longitudinal direction.

Brackets 18 prevent rearward or forward movement of column 14 and also work in conjunction with beams 16 to prevent those columns 14 without brackets 18 from tipping over rearwardly or forwardly. As it is envisioned that beams 16 may or may not be attached to the structure, brackets 18 may be solely responsible for preventing wall 10 from tipping over. Brackets 18 can be of any suitable material, preferably synthetic, more preferably poly-vinyl chloride (PVC) or other durable plastic.

Figure 5:
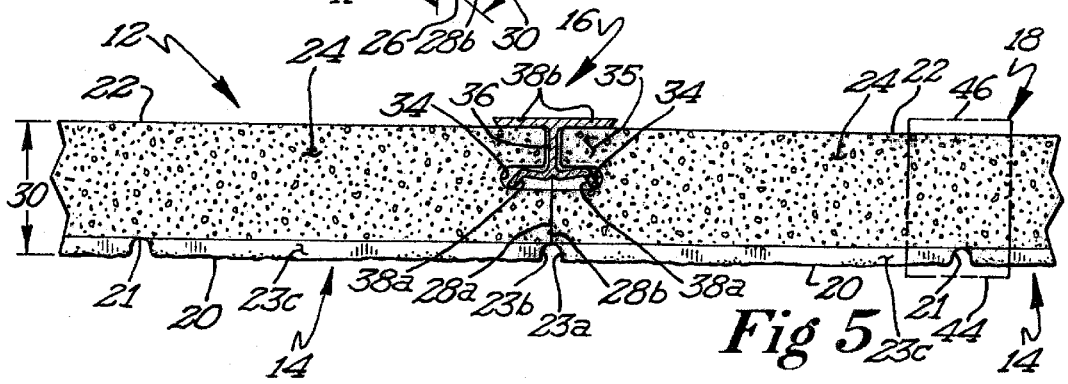
FIG. 5 is a plan view, taken generally along lines 5—5 of FIG. 1, of two adjacent blocks of the present invention abutted and held by a support beam.

Referring now to FIG. 5, a partial horizontal section of the wall structure 10 of FIG. 1 is depicted. As shown, a beam 16 operatively connects two adjacent blocks 12 of adjacent columns 14 to each other. Here, the v-shaped ribs 38A are positioned within grooves 34 of adjacent blocks 12 and ribs 38B are positioned against the rear faces 22 of adjacent blocks 12. With this configuration, the beams 16 are able to remain hidden from view and provide support along several axes (taken along the "z" and "x" directions in a three-dimensional coordinate system relative to a block). With the beam of this embodiment, the grooves 34 may be considerably larger than the thickness of the ribs 38A, without affecting the gripping ability of the beam 16. Thus, there may be quite a large space in front of the ribs 38A. Note that the distance between side surfaces 29A and 29B is less than the distance between side surfaces 28A and 28B. This is to allow the side surfaces 28A, 28B of adjacent blocks 12 to be brought into intimate contact with each other while providing enough space to accommodate the web 36 of the beam 16. Note that a bracket 18 is shown in dashed lines as it would be positioned relative to an uppermost block 12 of a column 14.

Figure 6:
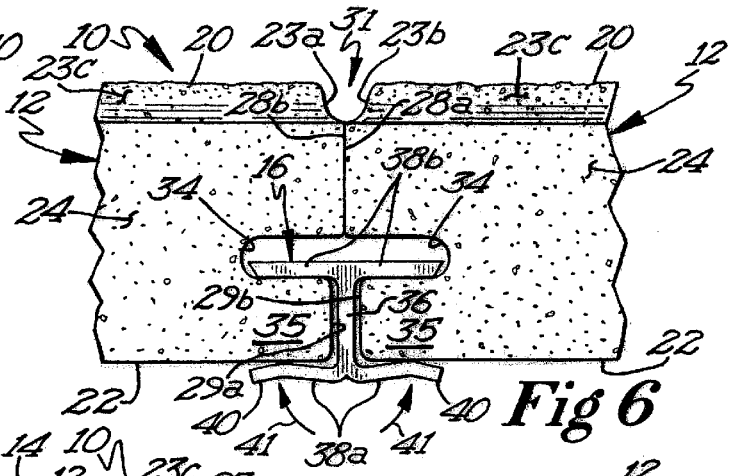
FIG. 6 is a plan view of two blocks abutted with a support beam installed using an alternative configuration.
Figure 7:
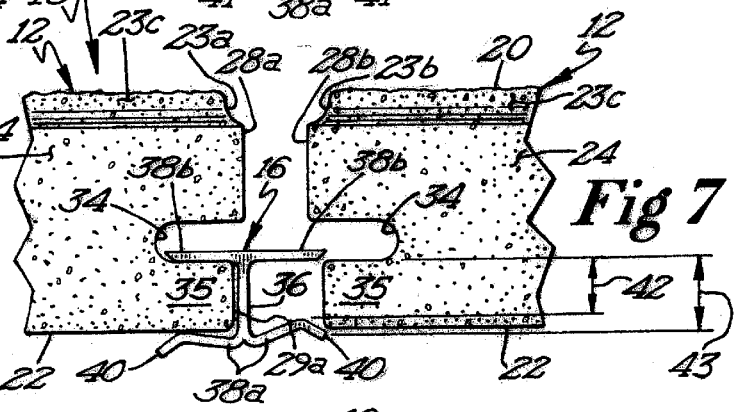
FIG. 7 is a plan view of two blocks being pressed together and resiliently deforming a support beam.

FIGS. 6 and 7 show a preferred beam arrangement in which the beam 16 shown in FIGS. 3 and 5 is reversed with respect to blocks 12 to which it is connected. That is, the ribs 38B are positioned within opposing grooves 34 and the v-shaped ribs are positioned against the rear faces 22 of blocks 12. This arrangement does not appreciably change the function of the beam 16 and the gripping ability of the beam 16, as discussed above, remains essentially the same.

As with the embodiment depicted in FIG. 5, the distance between side surfaces 29A and 29B is less than the distance between side surfaces 28A and 28B to allow the side surfaces 28A, 28B of adjacent blocks 12 to be brought into intimate contact with each other while providing enough space to accommodate the web 36 of the beam 16. Note also that when two adjacent blocks 12 are brought into contact with each other their corresponding margins 23A and 23B combine to form a profile that is substantially the same as the profile of splitting recess 21 (as shown in FIGS. 5, 6, 8, and 9). It will be appreciated that the splitting recess 21 and may have other profiles, such as a v-shape and that the corresponding margins 23 would be more beveled or chamfered.

Figure 8:
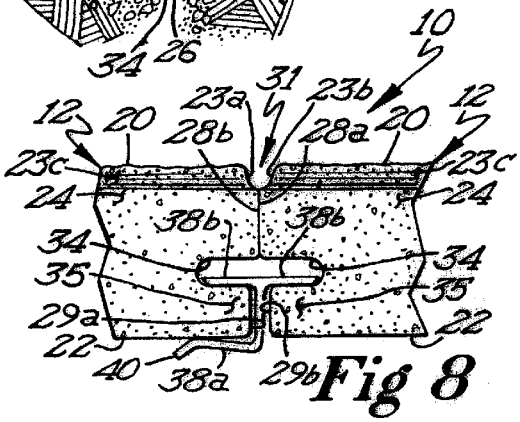
FIG. 8 is a plan view of two blocks abutted with an alternative embodiment of a support beam.
Figure 9:
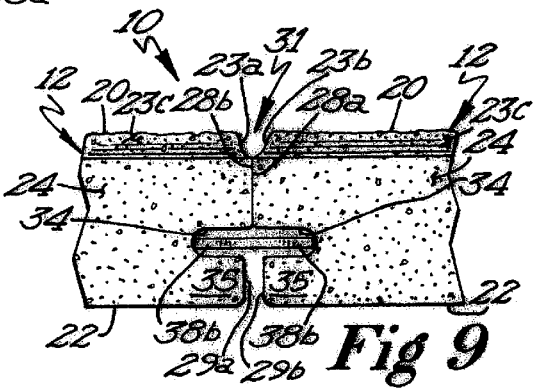
FIG. 9 is a plan view of two blocks abutted with another alternative embodiment of a support beam.

FIG. 8 shows an alternative embodiment of beam 16 having two ribs 38B but only one resiliently deformable rib 38A. FIG. 9 shows yet another embodiment of a beam 16 comprising one pair of opposed ribs 38B such that the support beam 16 is essentially an elongate spline. It should be understood that for purposes of clarity, ribs 38B as depicted in FIGS. 8 and 9 are substantially thinner than the grooves 34 in which they are positioned, and that in actuality and ribs and grooves would be configured to effectively maintain blocks 12 in a coplanar relation with little or no play.

Figure 10:
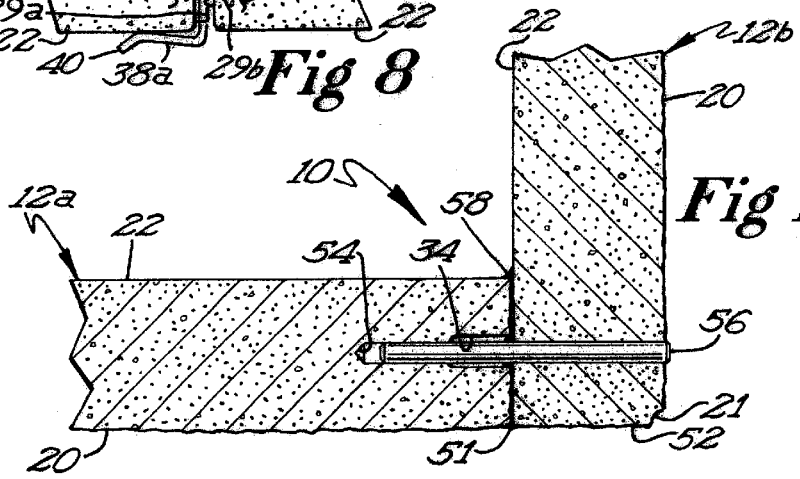
FIG. 10 is a plan view of an embodiment of a corner of the wall structure of the present invention.

FIG. 10 shows a preferred corner configuration using the blocks 12 of the present invention. The design of block 12 lends itself to the formation of corners without the need for mortar, corner braces, or other supports. Two blocks 12A and 12B are simply aligned to form a corner butt joint 51. Preferably block 12B is broken along its splitting recess 21 to form a new split face 52 which roughly matches split front face 20 of block 12A. Holes 54 are drilled through blocks 12A and 12B so that fastener 56 may be inserted therein. Generally, fastener 56 may be any suitable fastener, and preferably an appropriately sized pin, peg or screw. Alternatively, glue, preferably construction mastic 58, may be applied instead of or, more preferably, in combination with fasteners 56.

FIGS. 11–15 illustrate an additional embodiment of the present invention. Starting with FIG. 11, the wall structure 10 of this embodiment is depicted as it may be used in conjunction with an elevated structure "S." As with the wall structure depicted in FIG. 1, this wall structure 10 is comprised of a plurality of blocks 12 arranged in columns 14, with the columns 14 held in place by vertically oriented, lateral support beams 16, and with each beam 16 operably connecting adjacent columns 14 together. The brackets 19 used in this embodiment, however, differ from the u-shaped brackets 18 of the previously described embodiment in several respects. First, the brackets 19 are shaped differently than the brackets 18 of the previous embodiment. Instead of having an inverted u-shaped configuration as with bracket 18, the bracket 19 of this embodiment has a single, downwardly extending portion. Another difference is that rather than positioning a portion of a block 12 within an opening 60 defined by a pair of walls 44, 46, the bracket 19 of this embodiment has a wall engaging portion 62 that extends downwardly into vertical grooves 34 at the sides of blocks 12. Another difference between brackets 18 and 19 is that bracket 18 connects to a column 14 in a generally central location, whereas the brackets 19 of this embodiment connect at the sides of a column 14. As with the previously described brackets 18, these brackets 19 help to stabilize and prevent the wall structure 10 from tipping rearwardly or forwardly. The brackets 19 also prevent the wall structure from shifting from side to side.

Figures 11, 12, 13, 14:
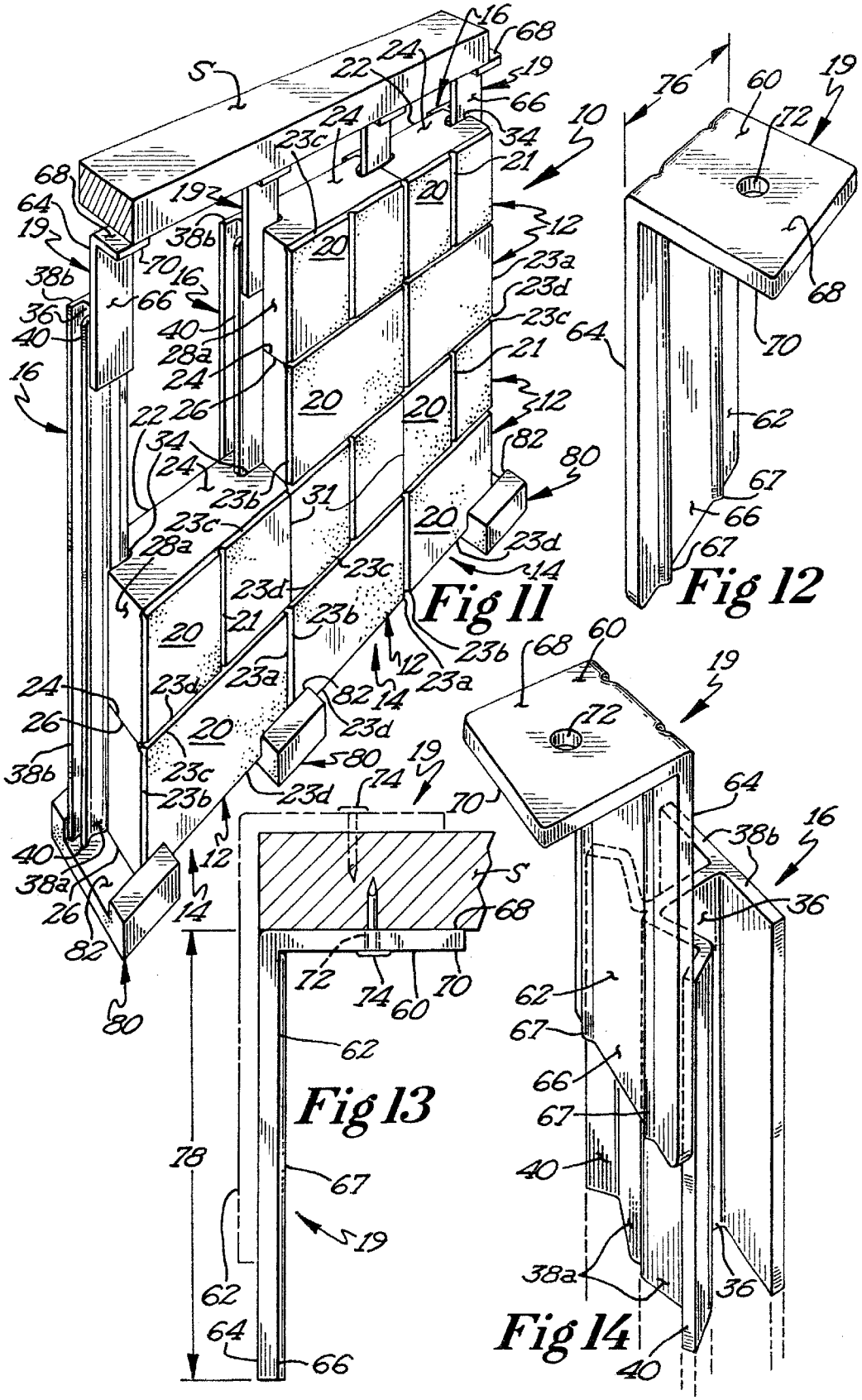
FIG. 11 is a partial, perspective view of an embodiment of a wall structure of the present invention and a preferred attachment bracket therefor.
FIG. 12 is a perspective view of a preferred embodiment of the attachment bracket of FIG. 11.
FIG. 13 is a side plan view of the bracket of FIG. 12 attached to a surface of a structure.
FIG. 14 is a perspective view if the attachment bracket of FIG. 12 in juxtaposition with a preferred embodiment of the support beam of the present invention.

For purposes of illustration, the size of the wall structure 10 of this embodiment has been limited three columns 14 and four courses, with the two uppermost blocks of the left column 14 removed to reveal the juxtaposition between the brackets 19, beams 16 and blocks 12. Note that the wall structure 10 depicted in this embodiment also includes a plurality of base blocks 80 that are positioned beneath the columns 14 at the junction where they connect to the beams 16. Preferably, each base block 80 may be provided with a setting channel 82 that is configured and arranged to receive the bottom edges of one or more columns of blocks in a constrained relation. Note that the base block 80 for the middle and right columns 14 has been removed and replaced with a bar (not shown) that spans the bottom of the middle and right columns 14. This construction may be used when the use of individual base blocks is not possible or desirable. Also note that the wall structure 10 is depicted as having a running bond on its three lowermost courses. As can be seen, the bottom and third courses of blocks do not have splitting recesses. They do, however have their perimeter marginal areas 23A–D worked. The second course of blocks, on the other hand, have splitting recesses 21 and have only their horizontal marginal areas 23C, 23D worked. Thus, each column 14 will have blocks with alternating front faces. When the columns of blocks are positioned adjacent each other in the normal assembly procedure some of the blocks will form tight joints 31 and some of the blocks will form joints that appear substantially thicker. Thus, from a distance, the wall structure 10 will give the impression that it was constructed of blocks and mortar in a conventional manner. It will be appreciated that the externally viewable surface of the wall structure depicted in FIG. 11 is merely one example of an externally viewable surface, and that many other externally viewable surfaces are possible. As used herein, the term "forward" means away from the center of the elevated structure (and along the "z" direction in a three-dimensional coordinate system relative to a block) and the term "rearward" means toward the center of the elevated structure (also along the "z" direction in a three-dimensional coordinate system relative to a block).

Since the blocks 12 and beams 16 used in this embodiment of the wall structure 10 are substantially identical to the blocks 12 and beams 16 depicted in FIGS. 2 and 3, and described above, they will not be described further.

Turning now to FIGS. 12–14, the preferred embodiment of bracket 19 depicted in FIG. 11 will now be discussed. As can be seen in FIGS. 12 and 13, the bracket 19 comprises a structure engaging portion 60 and a wall engaging portion 62. The wall engaging portion 62 of the bracket 19 includes opposing surfaces 64, 66 which are arranged and configured to contact a portion of a beam 16 and a portion of a block 12, respectively. If desired, the wall engaging portion 62 may be provided with strengthening creases 67. As will be appreciated, the wall engaging portion 62 of the bracket 19 has a width 76 and a length 78 whose dimensions correspond to the particular blocks that are being used to construct a wall, and will be discussed only in general terms. Thus, the width 76 may range from a distance roughly equivalent to the depth of a single groove 34 in one block, to a distance roughly equivalent to the depth of two grooves 34 of opposing blocks. The width may also be roughly equivalent to the width of the web 36 of the beam 16 so that the wall engaging portion of the bracket may be oriented transversely to the wall structure (not shown). The length 78 may also vary depending upon the requirements of the wall structure. A typical width and length for a wall engaging portion 62 may be on the order of two inches by four inches, and a typical width and length for a structure engaging portion 60 may be on the order of two inches by one-and-a-half inches.

It will be appreciated that the bracket 19 be formed from material that may be modified or otherwise altered to fit a particular application. Thus, for example, the width and/or length of the wall engaging portion may be cut-to-length or otherwise tailored at a jobsite without appreciably delaying or hindering construction.

The structure engaging portion 60 of the bracket 19 also includes opposing surfaces 68, 70. However, in this embodiment, only opposing surface 68 is configured to contact a portion of a structure (See, FIGS. 11 and 13). As depicted, the structure engaging portion 60 is attached to a lower surface of a structure "S" by an upwardly extending fastening element 74. It is understood, however, that the attachment surface of the structure "S" may be an upper surface, in which case the opposing surface 70 would contact the surface of the structure and the fastening element would extend downwardly from surface 68 (shown in dashed lines). As shown in FIG. 13, the structure engaging portion 60 and the wall engaging portion 62 are planar and substantially orthogonal with respect to each other. It is understood, however, that the wall engaging portion 62 and the structure engaging portion 60 need not be orthogonal to each other. They may be linearly aligned, for example. It is also envisioned that the wall engaging and structure engaging portions may be formed in other configurations. For instance, either portion 60, 62 may be formed with u-shaped profiles that enable the portions 60, 62 to straddle sections of the wall and/or structure (not shown). The structure engaging portion 60 is provided with an aperture 72 that may be used with a conventional fastening element 74. For purposes of this application, the term fastening element may include mechanical fasteners such as screws, nails, bolts, rivets, or their equivalents, and/or adhesives, weldments, or the like. Alternatively, the structure engaging portion 60 may be provided with an integral fastening element so that the portion 60 may be driven into or otherwise attached to a support.

Referring now to FIGS. 11 and 14, the juxtaposition between a bracket 19 and a beam 16 can be seen. Preferably, in use, the wall engaging portion 62 of the bracket 19 is positioned within the space created by the confronting grooves 34 of adjacent blocks 12 such that one opposing surface 64 confronts the ribs 38 of the beam, and the other opposing surface confronts a wall of the groove 34. As depicted, ribs 38A are confronted by the surface 64, however, it could just as easily by ribs 38B (as shown in FIGS. 6, 7 and 8) depending on how the beam 16 is connected to the blocks. It should also be noted that the bracket 19 could also be rotated so that the positions of the opposing surfaces 64, 66 are reversed and one opposing surface 66 would confront the ribs 38 of the beam 16 and the other opposing surface would confront a wall of the groove 34.

In use, the bracket 19 will be operatively connected to a support where it will be in a fixed position relative to a beam 16 and blocks 12. That is, the beam 16 may move relative to the bracket 19 and the blocks 12 may move relative to the bracket 19. Equally as important, the beam 16 and the blocks 12 may move relative to each other. This feature allows columns 14 of blocks 12 to have independent vertical movement without harming or damaging the integrity of the wall structure 10.

Figure 15:
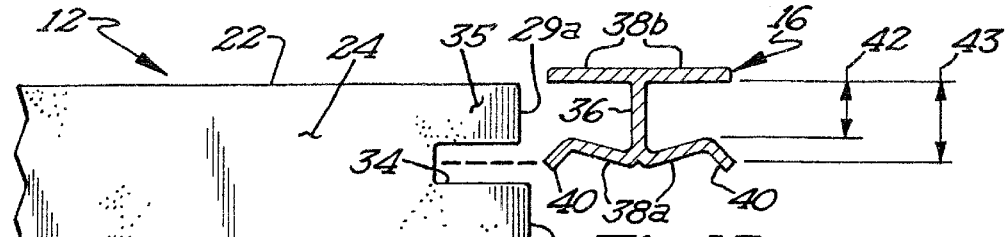
FIG. 15 is a top plan view of a portion of a block and a support beam prior to connection therewith.
Figure 16:
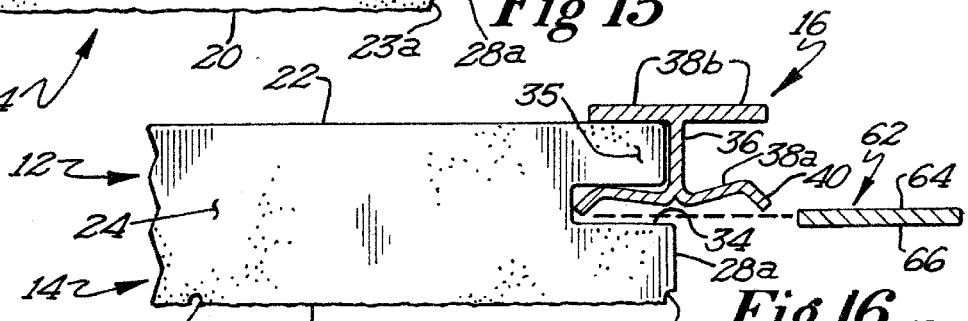
FIG. 16 is a top plan view of a portion of a block with a support beam connected thereto, and the wall contacting portion of a the bracket of FIG. 11 prior to connection therewith.
Figure 17:
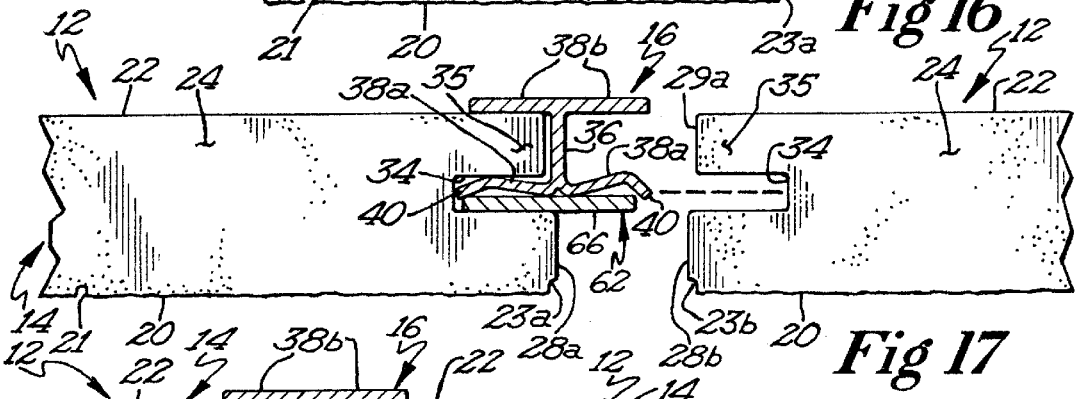
FIG. 17 is a top plan view of a portion of a block with a support beam and bracket connected thereto, and a second portion of a block prior to connection therewith.
Figure 18:
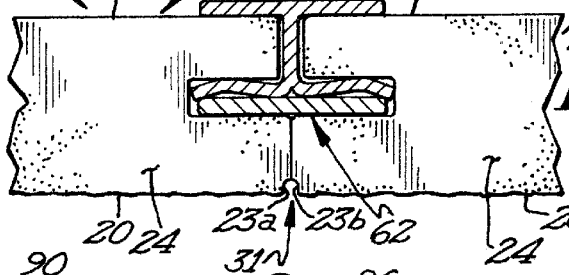
FIG. 18 is a top plan view of an assembled wall structure illustrating the positions of the blocks, support beam and attachment bracket relative to each other.

Referring now to FIGS. 15–18, operatively connecting a wall 10 to a structure (not shown) using the bracket 19 begins with a block 12 that is connected to a beam 16. As can be seen in FIG. 15, the leading edge of flange 40 will allow the rib 38A to be displaced as it encounters the block segment 35. As the beam 16 is connected to the block 12 as shown in FIG. 16, the block segment 35 is gripped by ribs 38A and 38B. At this point, a bracket 19 may be connected to the block 12 and the beam 16 by positioning the surfaces 64, 66 of the wall engaging portion 62 in confronting relation to the ribs 38 and side of the groove 34. The bracket 19 may then be slid along the longitudinal axis of the beam 16 until it is in position to be attached to a support. After the bracket 19 has been attached to a support, another block 12 may be connected to the beam 16. Note that FIGS. 15–18 represent the uppermost blocks of columns and that the brackets 19 would not normally be coextensive with the beams.

In a preferred method to operatively connect a wall to a structure using the aforementioned bracket, a person would prepare or otherwise select an appropriate location in which to construct a wall. The construction would begin by placing a first block having opposing side grooves in a desired position and orientation. Then, a second, similar block would be placed directly on top of the first block so that the opposing side grooves of the first and second blocks are in vertical alignment with each other and the first and second blocks form a column. Next, the first and second blocks would be operatively connected to each other along one of their respective sides by inserting a rib of first support beam into the aligned grooves and seating it securely.

Next, a bracket is positioned so that its wall engaging portion is collaterally aligned and in contact with the support beam such that it extends therewith along the groove in the block. The structure engaging portion of the bracket is then brought into position for attachment to a structure by sliding or otherwise manipulating the bracket in a direction towards the point of attachment on the structure (this is generally above and co-planar with the wall). The bracket is than attached to the structure using conventional techniques and technologies. The rib of a second support beam is then inserted into the aligned grooves of the opposite sides of the blocks, and a second bracket is used to operatively connect this portion of the wall to a structure using the aforementioned steps.

A second column comprising similarly configured third and a fourth blocks may now be constructed. The operation is much the same, except now the third block is positioned so that one of its sides is adjacent to one of the sides of the first block and its groove engages at least one other rib of one of the already positioned support beams. The fourth block is then positioned on top of the third block in a similar manner. That is, the fourth block is positioned so that one of its sides is adjacent to one of the sides of the second block and its groove engages at least one other rib of one of the already positioned support beam and the wall engaging portion of the already installed bracket.

After the second column is erected, the third and fourth blocks would be operatively connected to each other along their respective free side by inserting at least one rib of a third support beam into their aligned vertical groove of the respective sides of the first and second blocks and seating them securely, and that support beam would be operatively connected to a support by yet another bracket. And so on. It will be appreciated that other methods of constructing a wall structure using the aforementioned components are possible.

Figure 19A:
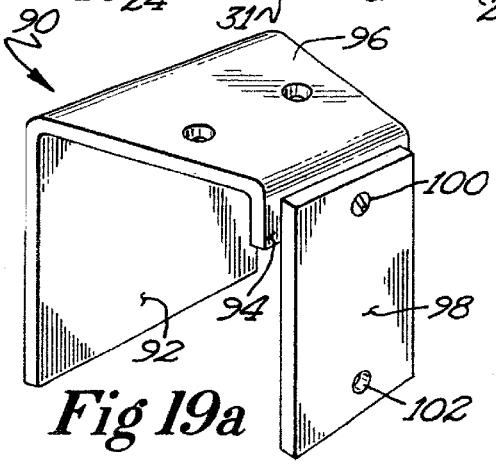
FIG. 19A is a perspective view of an alternative embodiment of an attachment bracket having an arm that is rotatably connected thereto, and which is in a first position; and, FIG. 19B is a perspective view of the attachment bracket of FIG. 19*a* in which the arm has been rotated to a second position.
Figure 19B:
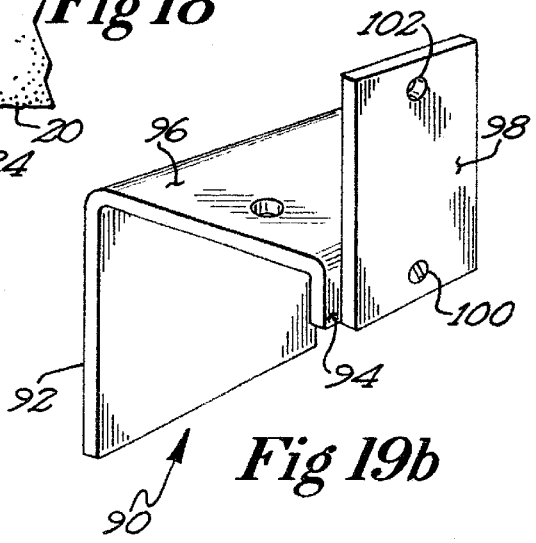

Referring now to FIGS. 19A and 19B, an alternative embodiment of an attachment bracket 90 is depicted. Here, the bracket 90 is similar to earlier discussed bracket 18 (see, FIG. 4) in that it has opposing walls 92, 94 that are connected to each other by a top wall or span 96, and which retain a portion of a block in a constrained relation. However, in this embodiment the shorter of the two walls 94 is provided with an arm 98 that is movably attached thereto by a connector 100, such as a rivet. As depicted in FIG. 19A, the arm 98 is in a first position where it extends towards a block (not shown). In this position, the bracket 90 resembles bracket 18 (see, FIG. 4) and may be attached at or near the underside of a structure in the usual manner, via the span 96.

In situations where it is not possible to easily attach the bracket 90 to the underside of a structure, a user of the bracket 90 need only rotate the arm 98 to a second position so that it extends away from a block (not shown) as depicted in FIG. 19B. In this position, the bracket may be attached to a vertical surface via the arm by a conventional fastener, such as a nail or screw, which extends through an aperture 102. Alternatively, the bracket may be secured to a vertical surface by a suitable adhesive. As will be appreciated, the bracket 90 may be oriented so that either one of the walls 92, 94 may be in confronting relation with the front face of a block.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A wall system attachable to a structure, the wall system comprising:

a vertically oriented, elongate beam comprising:
- a vertical web; and,
- at least one vertical rib extending outwardly from said web;

a plurality of blocks arranged in a column, each of said blocks comprising:
- a front face;
- a rear face;
- a top surface;
- a bottom surface;
- opposing side surfaces, with each side surface having a vertically oriented groove configured to receive a portion of said at least one vertical rib; and, a bracket for operatively connecting said wall system to a structure, said bracket comprising:
- a structure engaging portion; and,
- a wall engaging portion;

wherein said blocks forming said column are arranged such that the grooves of the opposing side surfaces of adjacent courses are in alignment with each other;

wherein said rib of said support beam is positioned in said grooves, thereby providing strength to said column;

wherein said structure engaging portion of said bracket is constructed and arranged to connect said bracket to a structure; and wherein said wall engaging portion of said bracket is constructed and arranged to extend into said groove of said column and thereby operatively connect said wall system to a structure.

2. The wall system of claim 1, wherein said wall engaging portion is collaterally aligned with said elongated beam.

3. The wall system of claim 1, wherein said column slidingly contacts the wall engaging portion of said bracket.

4. The wall system of claim 1, wherein said elongated beam slidingly contacts the wall engaging portion of said bracket.

5. The wall system of claim 1, wherein said column and said elongated beam slidingly contact the wall engaging portion of said bracket.

6. The wall system of claim 1, wherein said structure engaging portion and said wall engaging portion of said bracket are angled with respect to each other.

7. The wall system of claim 1, wherein said structure engaging portion and said wall engaging portion of said bracket are orthogonal with respect to each other.

8. The wall system of claim 1, wherein said wall engaging portion has at least one strengthening crease.

9. A bracket in combination with a structure and a wall of the type comprising a plurality of columns operatively connected together by at least one elongated vertically oriented support beam, the bracket comprising: a structure engaging portion and a wall engaging portion, with the structure engaging portion attached to the structure, and with the wall engaging portion slidingly constrained by a support beam and a column;

wherein the bracket operatively connects the wall to the structure while permitting movement relative thereto in a predetermined direction.

10. The combination of claim 9, wherein the wall engaging portion is constructed and oriented to be slidingly constrained between a support beam and a column.

11. The combination of claim 9, wherein said structure engaging portion and said wall engaging portion are angled with respect to each other.

12. A bracket in combination with a structure and a wall of the type comprising a plurality of columns, with each column comprising a plurality of blocks, with each block having vertically aligned side grooves, and where the plurality of blocks are in a stacked relation and operatively connected to each other along their aligned side grooves by at least one elongated support beam, the bracket comprising: a structure engaging portion and a wall engaging portion, with the structure engaging portion attached to the structure, and with the wall engaging portion slidingly constrained by a support beam and a column;

wherein the bracket operatively connects the wall to the structure while permitting movement relative thereto in a predetermined direction.

13. The combination of claim 12, wherein the wall engaging portion is constructed and oriented to be slidingly constrained between a support beam and a column.

14. The combination of claim 12, wherein said structure engaging portion and said wall engaging portion are angled with respect to each other.

15. A wall system attachable to a structure, the wall system comprising:

a plurality of blocks, each of said blocks comprising:
- a front face;
- a rear face;
- a top surface;
- a bottom surface;
- opposing side surfaces, with each side surface having a substantially vertically oriented groove; and, a bracket for operatively connecting said wall system to a structure, said bracket comprising:
- a structure engaging portion; and,
- a wall engaging portion;

wherein said blocks are arranged such that the grooves of adjacent blocks in a course are in confronting alignment with each other;

wherein said wall engaging portion of said bracket is constructed and arranged to extend into the grooves of adjacent blocs in a course; and, wherein said structure engaging portion of said bracket is constructed and arranged to connect said bracket to a structure and thereby operatively connect said wall system thereto.

16. The wall system of claim 15, wherein said structure engaging portion and said wall engaging portion of said bracket are angled with respect to each other.

17. A method of operatively connecting a wall to a structure, the method comprising the steps of:

a. providing:

a plurality of blocks, with each of said blocks having; a front face; a rear face; a top surface; a bottom surface; and opposing side surfaces, with each side surface having a vertically oriented groove configured to receive a portion of said at least one elongated rib;

a beam having an elongated web having at least one elongated rib coextensive therewith and projecting outwardly therefrom; and, a bracket having a structure engaging portion and a wall engaging portion;

b. positioning a first block in a predetermined location and orientation;

c. placing a second block on top of the first block to form a column, wherein the opposing side grooves of the blocks are in alignment with each other;

d. positioning a support beam along one side of the column such that the rib of the beam protrudes into the groove;

e. positioning the wall engaging portion of the bracket so that it protrudes into the groove; and, f. attaching the structure engaging portion of the bracket to the structure to thereby operatively connect the wall to the structure.

* * * * *